US008996377B2

(12) United States Patent
Zhao et al.

(10) Patent No.: US 8,996,377 B2
(45) Date of Patent: Mar. 31, 2015

(54) BLENDING RECORDED SPEECH WITH TEXT-TO-SPEECH OUTPUT FOR SPECIFIC DOMAINS

(75) Inventors: Sheng Zhao, Beijing (CN); Peng Wang, Beijing (CN); Difei Gao, Beijing (CN); Yijian Wu, Beijing (CN); Binggong Ding, Beijing (CN); Shenghua Ye, Beijing (CN); Max Leung, Kirkland, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 330 days.

(21) Appl. No.: 13/547,459

(22) Filed: Jul. 12, 2012

(65) Prior Publication Data

US 2014/0019134 A1 Jan. 16, 2014

(51) Int. Cl.
*G10L 13/00* (2006.01)
*G10L 13/08* (2013.01)

(52) U.S. Cl.
CPC ..... *G10L 13/08* (2013.01)
USPC ..... 704/260; 704/258

(58) Field of Classification Search
CPC ..... G10L 13/08; G10L 13/02; G10L 13/07; G10L 13/027
USPC ..... 704/258–269
See application file for complete search history.

(56) References Cited

U.S. PATENT DOCUMENTS

| | | | | |
|---|---|---|---|---|
| 6,496,801 | B1 * | 12/2002 | Veprek et al. | 704/260 |
| 7,996,214 | B2 | 8/2011 | Bangalore et al. | |
| 8,027,835 | B2 * | 9/2011 | Aizawa | 704/258 |
| 2003/0187651 | A1 * | 10/2003 | Imatake | 704/269 |
| 2003/0216921 | A1 | 11/2003 | Bao et al. | |
| 2005/0094475 | A1 * | 5/2005 | Naoi | 365/232 |
| 2005/0256716 | A1 * | 11/2005 | Bangalore et al. | 704/260 |
| 2005/0288935 | A1 | 12/2005 | Lee et al. | |
| 2008/0065383 | A1 * | 3/2008 | Schroeter | 704/260 |
| 2008/0177541 | A1 | 7/2008 | Satomura | |
| 2008/0243511 | A1 * | 10/2008 | Fujita et al. | 704/260 |
| 2008/0270140 | A1 * | 10/2008 | Hertz et al. | 704/267 |
| 2009/0018837 | A1 * | 1/2009 | Aizawa | 704/260 |
| 2009/0048843 | A1 | 2/2009 | Nitisaroj et al. | |
| 2009/0254345 | A1 | 10/2009 | Fleizach et al. | |
| 2010/0250254 | A1 * | 9/2010 | Mizutani | 704/260 |
| 2014/0019134 | A1 * | 1/2014 | Zhao et al. | 704/260 |

OTHER PUBLICATIONS

"Developing for Speech", Retrieved on: Jan. 20, 2012, Available at: http://msdn.microsoft.com/en-us/library/bb756992.aspx.

Sproat, et al., "A Markup Language for Text-To-Speech Synthesis", In Proceedings of Eurospeech, 1997, 4 pages.

* cited by examiner

*Primary Examiner* — Samuel G Neway
(74) *Attorney, Agent, or Firm* — Steven Spellman; Jim Ross; Micky Minhas

(57) ABSTRACT

A text-to-speech (TTS) engine combines recorded speech with synthesized speech from a TTS synthesizer based on text input. The TTS engine receives the text input and identifies the domain for the speech (e.g. navigation, dialing, . . . ). The identified domain is used in selecting domain specific speech recordings (e.g. pre-recorded static phrases such as "turn left", "turn right" . . . ) from the input text. The speech recordings are obtained based on the static phrases for the domain that are identified from the input text. The TTS engine blends the static phrases with the TTS output to smooth the acoustic trajectory of the input text. The prosody of the static phrases is used to create similar prosody in the TTS output.

20 Claims, 9 Drawing Sheets

BLENDING RECORDED SPEECH WITH TEXT-TO-SPEECH OUTPUT FOR SPECIFIC DOMAINS

BACKGROUND

Text-to-Speech (TTS) systems are becoming increasingly popular. The TTS systems are used in many different applications such as navigation, voice activated dialing, help systems, banking and the like. In many TTS applications, high quality recorded speech is used for specific prompts (e.g. turn left, turn right . . . ) that are specific to the application. This recorded speech is then combined with output from a TTS synthesizer according to definitions provided by a developer. Combining the recorded speech with output from the TTS system can be time consuming and difficult.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A text-to-speech (TTS) engine combines recorded speech with synthesized speech from a TTS synthesizer based on text input. The TTS engine receives the text input and identifies the domain for the speech (e.g. navigation, dialing, . . . ). The identified domain is used in selecting domain specific speech recordings (e.g. pre-recorded static phrases such as "turn left", "turn right" . . . ) from the input text. The speech recordings are obtained based on the static phrases for the domain that are identified from the input text. The TTS engine blends the static phrases with the TTS output to smooth the acoustic trajectory of the input text. The prosody of the static phrases is used to create similar prosody in the TTS output.

DETAILED DESCRIPTION

Figure 1:
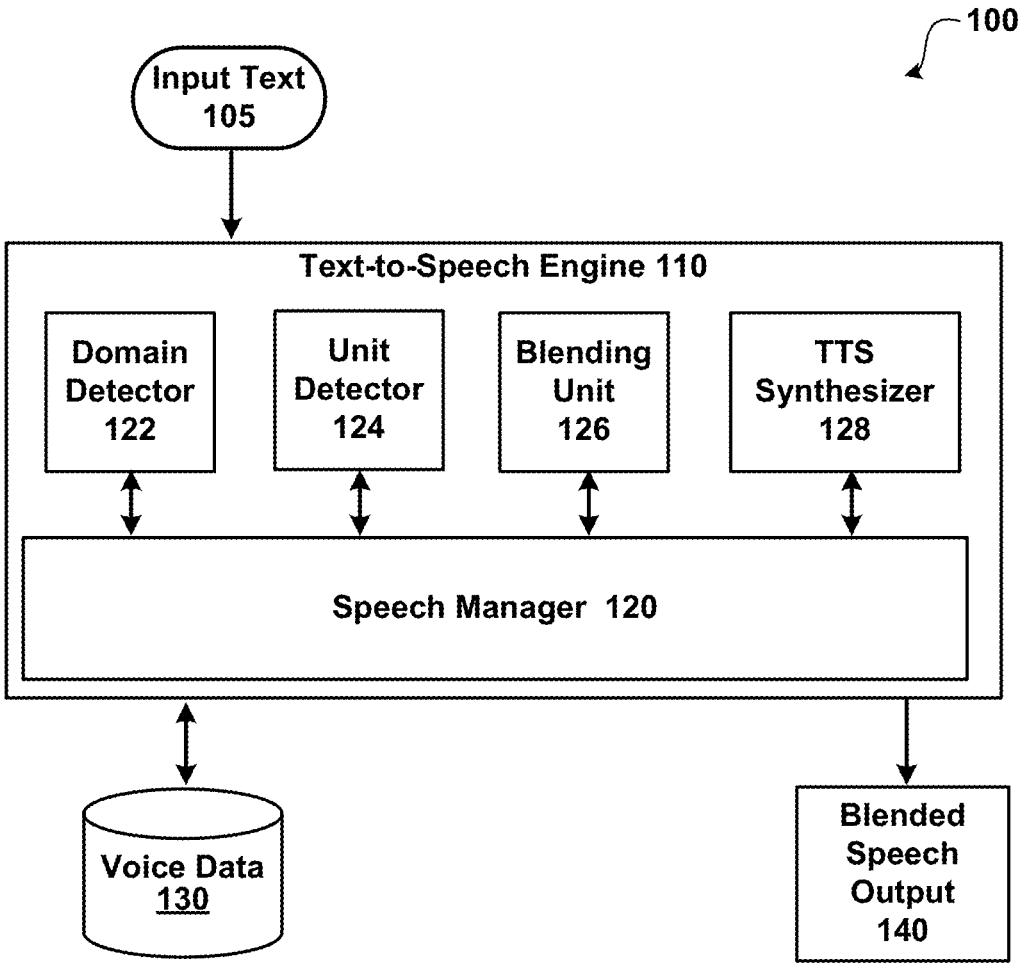
FIG. 1 illustrates an exemplary objective intelligibility assessment Text-To-Speech (TTS) system.

Referring now to the drawings, in which like numerals represent like elements, various embodiments will be described.

FIG. 1 illustrates an exemplary objective intelligibility assessment Text-To-Speech (TTS) system. As illustrated, system 100 includes input text 105, TTS engine 110, voice data 130 and blended speech output 140. TTS engine 110 includes speech manager 120, domain detector 122, static phrase detector 124, blending unit 126 and TTS synthesizer 128.

Speech manager 120 is configured to combine recorded speech with synthesized speech based on input text. The speech manager 120 illustrated in TTS engine 110 receives input text 105 and identifies the domain for the speech using domain detector 122. Generally, a domain is specific to a type of application (e.g. navigation, dialing, virtual assistants, and the like . . . ). Each domain typically accesses specific recordings from one or more data stores that includes definitions of the recording units for high frequent phrases and associated waveform data, acoustic trajectory data, and the like. The speech data for each domain may be stored in one or more data stores, such as voice data 130.

Narrators are typically used to create recorded speech of high quality for different domains. The recorded speech is stored within a data store, such as voice data 130. Some of the voice data may be static prompts for the specific domains. For example, prompts for a specific domain such as a navigation system are stored as static phrases (e.g. turn left, turn left onto, arrive at, stay to the right, merge onto, and the like. Other voice data is also stored in voice data 130 and/or some other data store. The speech is segmented into one or more of: phonemes, diphones, syllables, morphemes, words, phrases and sentences. Generally, each sound in a chosen language is recorded in at least one voice such that the TTS engine can select the appropriate sounds to create the desired speech.

Domain detector 122 may determine the domain from an analysis of the input text. For example, if the input text has text phrases such as turn left, turn left onto, arrive at, stay to the right, merge onto, and the like then the domain may be classified as a turn-by-turn navigation domain. According to an embodiment, domain detector 122 is configured to automatically determine the domain without using specific markup instructions within the input text 105. Domain detector 122 may also utilize one or more classification algorithms (e.g. an Adaboost (Classification) based algorithm) to assist in determining the domain.

Speech manager 120 uses the identified domain and unit detector 124 to determine if there are domain specific speech recordings (e.g. pre-recorded static phrases) directly from input text 105. Speech recordings are obtained from voice data 130 based on the static phrases for the domain that are identified from input text 105. Unit detector 124 classifies the static parts (or prompts) in the specific domains as non-uniform units as identified from input text 105.

For example, assume a portion of the text input contains the following: Turn left onto Villa street; Bear right onto North road; Depart Gore Orphanage Road; Arrive at Manning Avenue; Drive 1.2 miles; . . . Unit detector 124 and identifies the static parts as non-uniform units (bolded portions are classified as non-uniform units):: Turn left onto Villa street; Bear right onto North road; Depart Gore Orphanage Road; Arrive at Manning Avenue; Drive 1.2 miles; . . . Unit detector 124 locates the recordings of the static phrases within voice data 130. As can be seen in the current example, the prompts for the domain in this example are classified as non-uniform units. According to an embodiment, not all of the prompts are classified as non-uniform units. For example, some units with a single short word (usually, functional words like "in", "at", "on") may not be defined as non-uniform units. Further, for some units with long phrases where some breaks are located within the phrase (e.g. "take the exit # and follow signs for", "at the end of the ramp # bear right on") may be split into several parts based on the breaks, and then each of the split parts may be defined as a non-uniform unit.

During runtime of the speech application, unit detector 124 detects the non-uniform units from the input text. Generally, the word and phoneme sequence of non-uniform units are matched. According to an embodiment, context constraints are not used during an initial matching that may result in some errors for the non-uniform units detection. For example, the non-uniform unit "drive" may be located in several different positions (beginning, ending) of phrase. According to an embodiment, the first word at the beginning of phrase is classified as non-uniform units. For example, if the phrase is drive two miles, then drive is classified as a non-uniform unit.

Some detected non-uniform units may overlap. For example, the non-uniform units "turn left" and "turn left onto" overlaps. When the input text has the word sequence of "turn left onto", both non-uniform units (turn left" and "turn left onto") match with the input text. In the current example, "turn left" is a mismatch. Some identified static phrases may cross overlap (i.e. ABCD->"ABC"+"D" or "A"+"BCD"). In the cross overlap case, context constraints may be used to distinguish them. The following is an example of context constraints that may be used: Unit position in the phrase: begin, middle, end or single; Left/right word type: such as digit, acronym, . . . A maximum matching length may also be used to help during the non-uniform matching. For example, the non-uniform units are matched using the maximum matching length.

Blending unit 126 is configured to blend the static parts of the input text with the dynamic parts of the input text. Blending unit 126 uses the prosody contour (pitch/duration) for the non-uniform units. The prosody contour is stable for a domain since there is limited variation in narration of the static parts. The prosody contour from the non-uniform units is used to refine the target prosody trajectory. The refined target trajectory is used to calculate the target cost.

The following is an example of a target trajectory refinement process that refines the pitch contour. (1) For each basic unit related to the non-uniform unit, the candidate F0 mean is calculated (denote as $m_i^{cand}$, i=1, . . . , N) from the F0 values of all non-uniform candidates. (2) Calculate the target F0 mean (denote as $m_i^{tgt}$, i=1, . . . , N) for each unit based on the target pitch contour ($O_t^{tgt}$, t=1, . . . , T). (3) Based on the distance between $m_i^{cand}$ and $m_i^{tgt}$ windowed weight functions are used to add the weighted distance to the target pitch contour to obtain the refined pitch contour.

The TTS engine blends the static phrases with the TTS output to smooth the acoustic trajectory of the input text. The prosody of the static phrases is used to create similar prosody in the TTS output.

Figure 2:
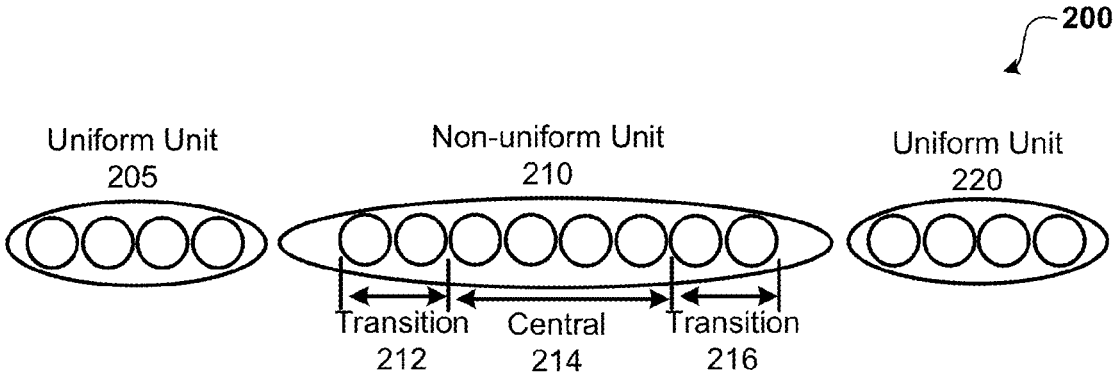
FIG. 2 shows splitting a non-uniform unit into different parts.

FIG. 2 shows splitting a non-uniform unit into different parts. As illustrated, FIG. 2 includes uniform unit 205, non-uniform unit 210, and uniform unit 220.

During unit pre-selection, unit candidates are pre-selected for non-uniform unit 210. Non-uniform unit 210 is split into different parts comprising transition part 212, central part 214 and transition part 216. Transition parts 212 and 216 are located near the boundary between the non-uniform units 210 and uniform units 205 and 220. The length of transition part is configurable. For example, the length may be set based on a size of the non-uniform unit, a pre-set size, a percentage of size of the non-uniform unit and the like. Other information may also be used to determine the transition length (e.g. use break information). The central part of non-uniform unit 210 is the part of non-uniform unit excluding the part of the non-uniform unit used for transition between the uniform units and the non-uniform unit.

Figure 3:
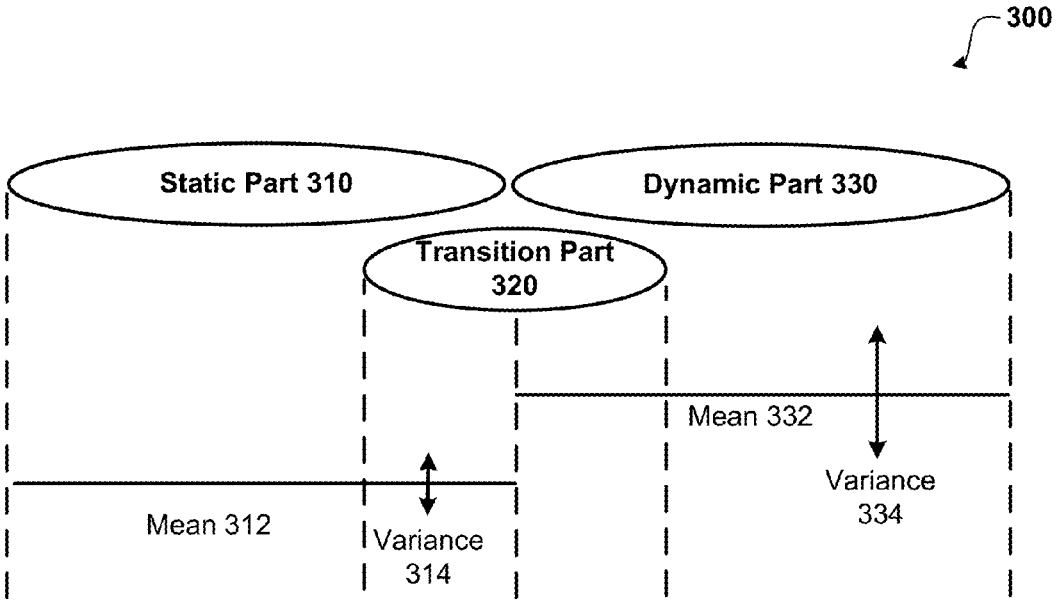
FIG. 3 shows blending in statistical parametric text-to-speech.

FIG. 3 shows blending in statistical parametric text-to-speech.

As illustrated, FIG. 3 comprises static part 310, transition part 320, and dynamic part 330.

For each non-uniform unit in the static part 310, the acoustic trajectory from the recording is extracted. A mean 312 is calculated for the static part 310 and a mean 332 for the dynamic part 330. Dynamic part 330 includes a variance 334. During runtime of the application using speech, the acoustic trajectory is used for synthesis instead of prediction from the statistical models after the non-uniform unit detection. For transition part 320, the variance 314 is enlarged before sending to prediction module. For the static part 310 not in transition part, the variance is set to 0, but for transition part 320, a small variance 314 is used to smooth the concatenation between the static part 310 and the dynamic part 300.

Figure 4:
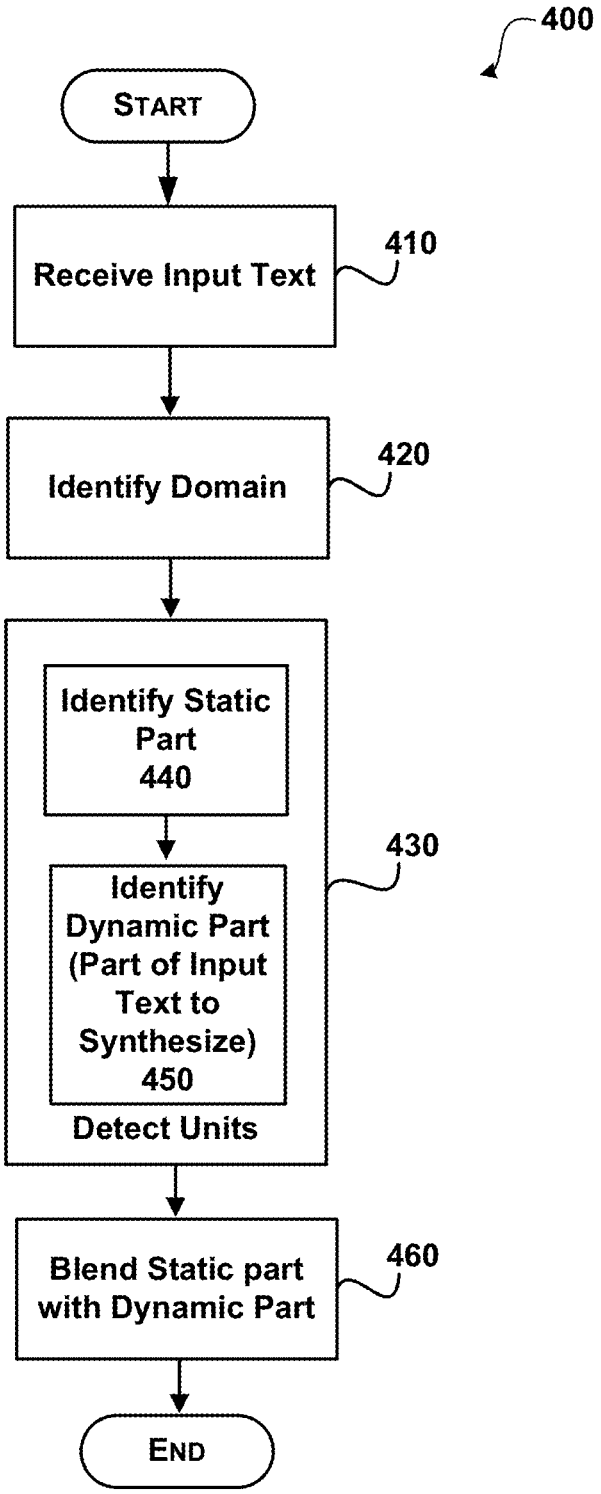
FIG. 4 shows an illustrative process for blending recorded speech with text-to-speech for specific domains.

FIG. 4 shows an illustrative process for blending recorded speech with text-to-speech for specific domains. When reading the discussion of the routines presented herein, it should be appreciated that the logical operations of various embodiments are implemented (1) as a sequence of computer implemented acts or program modules running on a computing system and/or (2) as interconnected machine logic circuits or circuit modules within the computing system. The implementation is a matter of choice dependent on the performance requirements of the computing system implementing the invention. Accordingly, the logical operations illustrated and making up the embodiments described herein are referred to variously as operations, structural devices, acts or modules. These operations, structural devices, acts and modules may be implemented in software, in firmware, in special purpose digital logic, and any combination thereof.

After a start operation, process 400 flows to operation 410, where the input text is received. For example, input text for a turn-by-turn navigation domain may be received. Generally, the input text is associated with a specific domain that includes pre-recorded static prompts for the speech application (e.g. navigation prompts, help prompts, dialing prompts . . . ).

Moving to operation 420, the domain that is associated with the input text is identified. According to an embodiment, the domain is automatically determined from an analysis of the input text without using specific markup instructions to identify the domain. For example, the input text may be searched for prompts that are matched with a specific domain. One or more classification algorithms (e.g. an Adaboost (Classification) based algorithm) may also be used assist in determining the domain.

Flowing to operation 430, the units are detected. The input text is analyzed to identify the non-uniform units in the input text that are static part (440) such as prompts used for the domain. The portion of the input text that is not pre-recorded and is to be synthesized is determined (450).

Flowing to operation 460, the static part and dynamic parts are blended together. Generally, the prosody contour (pitch/duration) for the non-uniform units of the static prompts are used to refine the target trajectory of the synthesized speech.

The process then flows to an end operation and returns to processing other actions.

Figure 5:
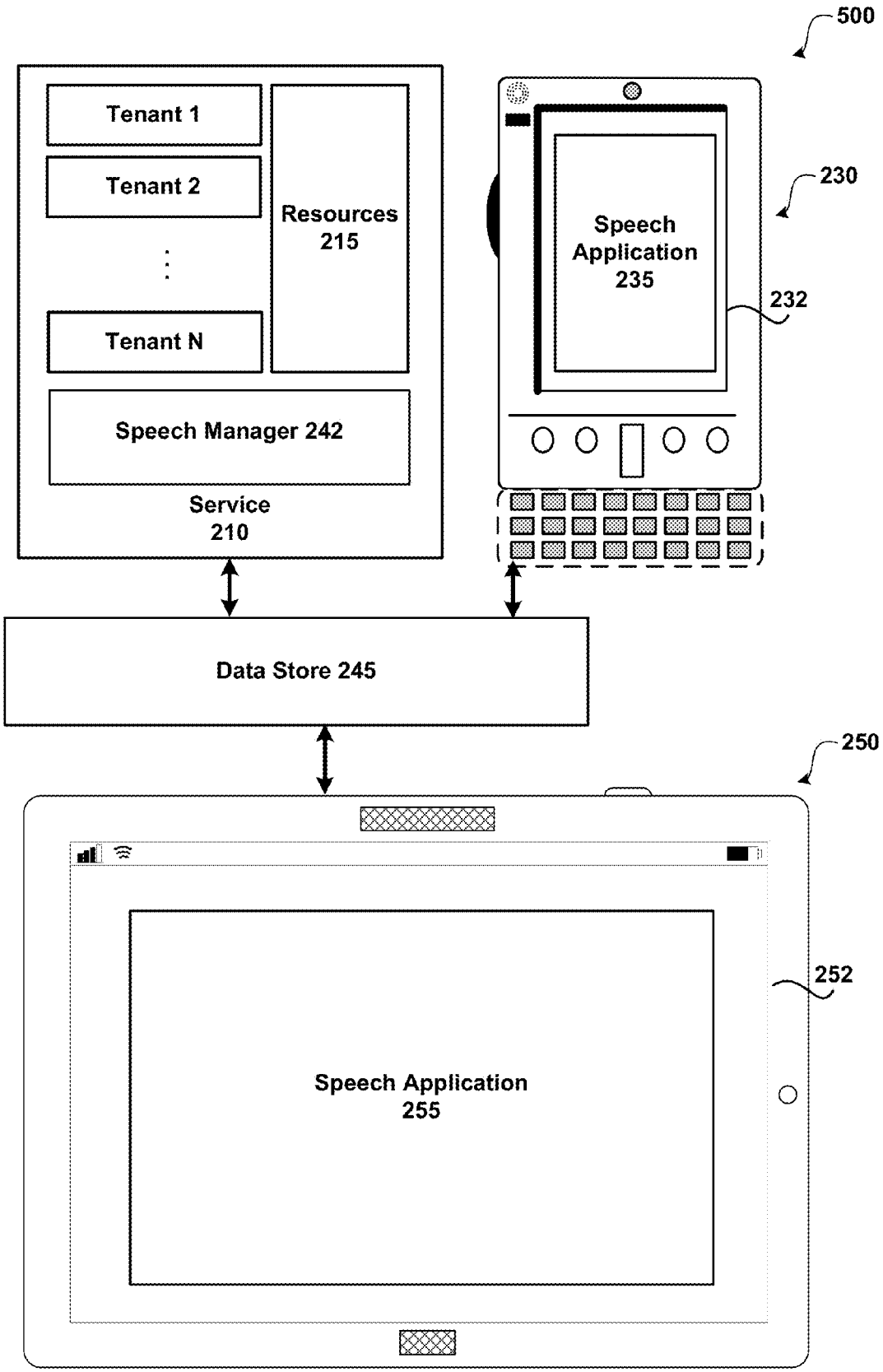
FIG. 5 illustrates an exemplary system for blending recorded speech with TTS.

FIG. 5 illustrates an exemplary system for blending recorded speech with TTS. As illustrated, system 500 includes service 210, data store 245, touch screen input device/display 250 (e.g. a slate) and smart phone 230.

As illustrated, service 210 is a cloud based and/or enterprise based service that may be configured to provide services, such as productivity services (e.g. MICROSOFT OFFICE 365 or some other cloud based/online service that is used to interact with items (e.g. messages, spreadsheets, documents, charts, and the like). The service may be interacted with using different types of input/output. For example, a user may use touch input, hardware based input, speech input, and the like. The service may provide speech output that combines pre-recorded speech and synthesized speech. Functionality of one or more of the services/applications provided by service 210 may also be configured as a client/server based application. For example, a client device may include an application that performs operations that utilize recorded speech that is blended with TTS. Although system 500 shows a service relating to productivity applications, other services/applications may be configured.

As illustrated, service 210 is a multi-tenant service that provides resources 215 and services to any number of tenants (e.g. Tenants 1-N). Multi-tenant service 210 is a cloud based service that provides resources/services 215 to tenants subscribed to the service and maintains each tenant's data separately and protected from other tenant data.

System 500 as illustrated comprises a touch screen input device/display 250 (e.g. a slate/tablet device) and smart phone 230 that detects when a touch input has been received (e.g. a finger touching or nearly touching the touch screen). Any type of touch screen may be utilized that detects a user's touch input. For example, the touch screen may include one or more layers of capacitive material that detects the touch input. Other sensors may be used in addition to or in place of the capacitive material. For example, Infrared (IR) sensors may be used. According to an embodiment, the touch screen is configured to detect objects that in contact with or above a touchable surface. Although the term "above" is used in this description, it should be understood that the orientation of the touch panel system is irrelevant. The term "above" is intended to be applicable to all such orientations. The touch screen may be configured to determine locations of where touch input is received (e.g. a starting point, intermediate points and an ending point). Actual contact between the touchable surface and the object may be detected by any suitable means, including, for example, by a vibration sensor or microphone coupled to the touch panel. A non-exhaustive list of examples for sensors to detect contact includes pressure-based mechanisms, micro-machined accelerometers, piezoelectric devices, capacitive sensors, resistive sensors, inductive sensors, laser vibrometers, and LED vibrometers.

According to an embodiment, smart phone 230 and touch screen input device/display 250 are configured to receive text/speech input and output text/speech. Smart phone 230 and touch screen input device/display 250 may also be configured to include speech applications (e.g. applications 235 and 255).

As illustrated, touch screen input device/display 250 and smart phone 230 shows exemplary displays 252/232 showing the use of an application using speech (235, 255). For example, a user associated with slate device 250 may be using application 255 to find a restaurant. A user associated with smartphone 230 may be interacting with application 235 that provides navigation services. Many other types of applications may utilize speech. Data may be stored on a device (e.g. smart phone 230, slate 250 and/or at some other location (e.g. network data store 245). The applications 235, 255 may be a client based application, a server based application, a cloud based application and/or some combination.

Speech manager 242 is configured to perform operations relating to speech applications. While manager 242 is shown within service 210, the functionality of the manager may be included in other locations (e.g. on smart phone 230 and/or slate device 250).

The embodiments and functionalities described herein may operate via a multitude of computing systems, including wired and wireless computing systems, mobile computing systems (e.g., mobile telephones, tablet or slate type computers, laptop computers, etc.). In addition, the embodiments and functionalities described herein may operate over distributed systems, where application functionality, memory, data storage and retrieval and various processing functions may be operated remotely from each other over a distributed computing network, such as the Internet or an intranet. User interfaces and information of various types may be displayed via on-board computing device displays or via remote display units associated with one or more computing devices. For example user interfaces and information of various types may be displayed and interacted with on a wall surface onto which user interfaces and information of various types are projected. Interaction with the multitude of computing systems with which embodiments of the invention may be practiced include, keystroke entry, touch screen entry, voice or other audio entry, gesture entry where an associated computing device is equipped with detection (e.g., camera) functionality for capturing and interpreting user gestures for controlling the functionality of the computing device, and the like.

Figure 6:
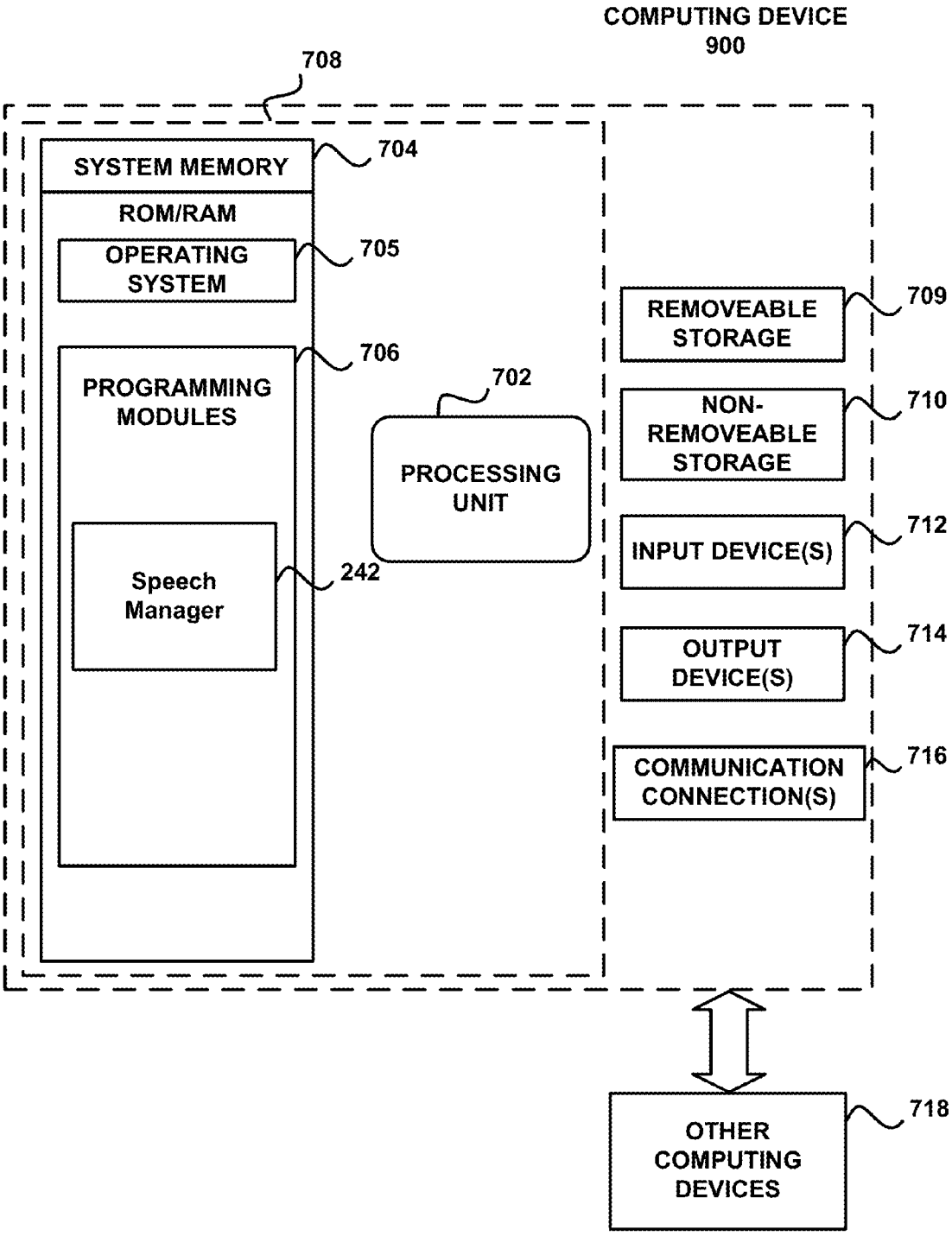
FIGS. 6-8 and the associated descriptions provide a discussion of a variety of operating environments in which embodiments of the invention may be practiced.
Figure 7A:
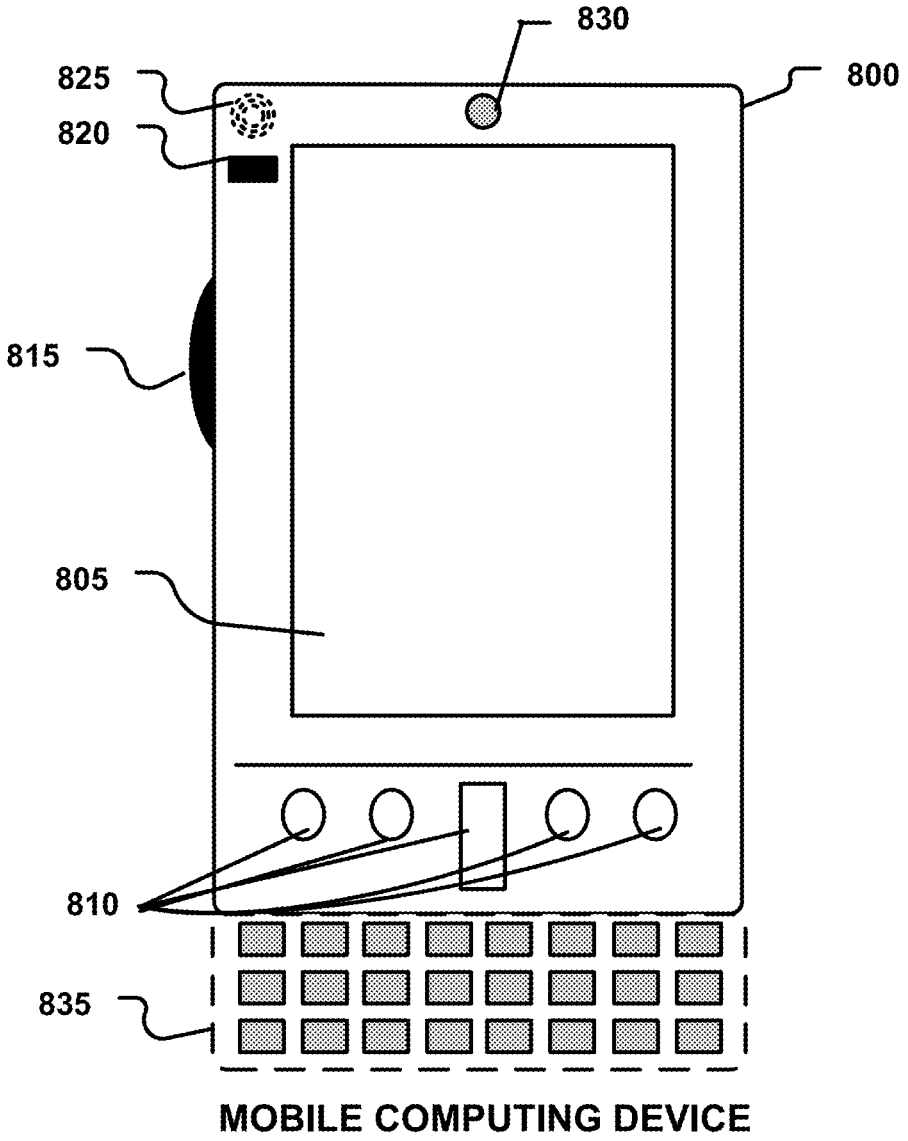
Figure 7B:
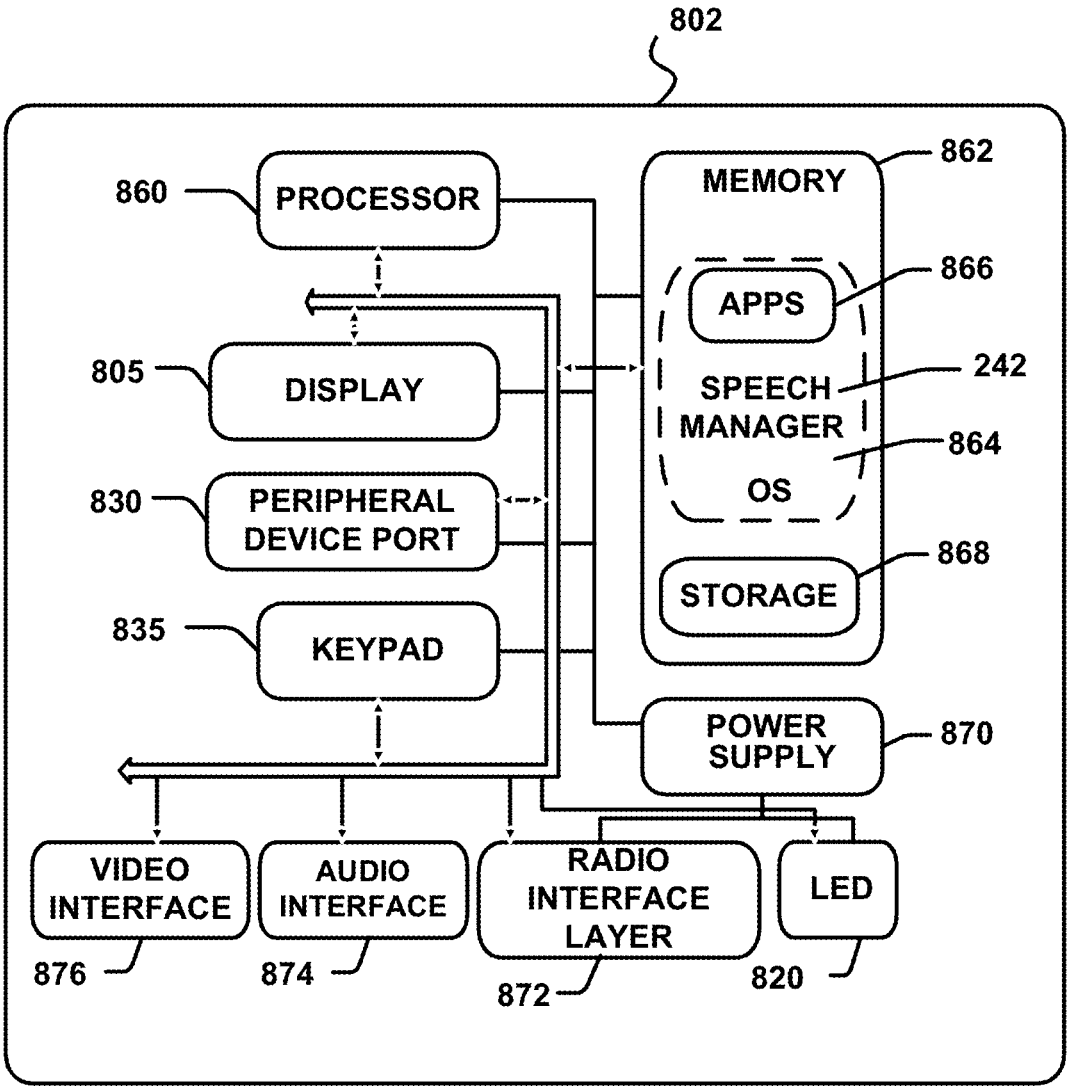
Figure 8:
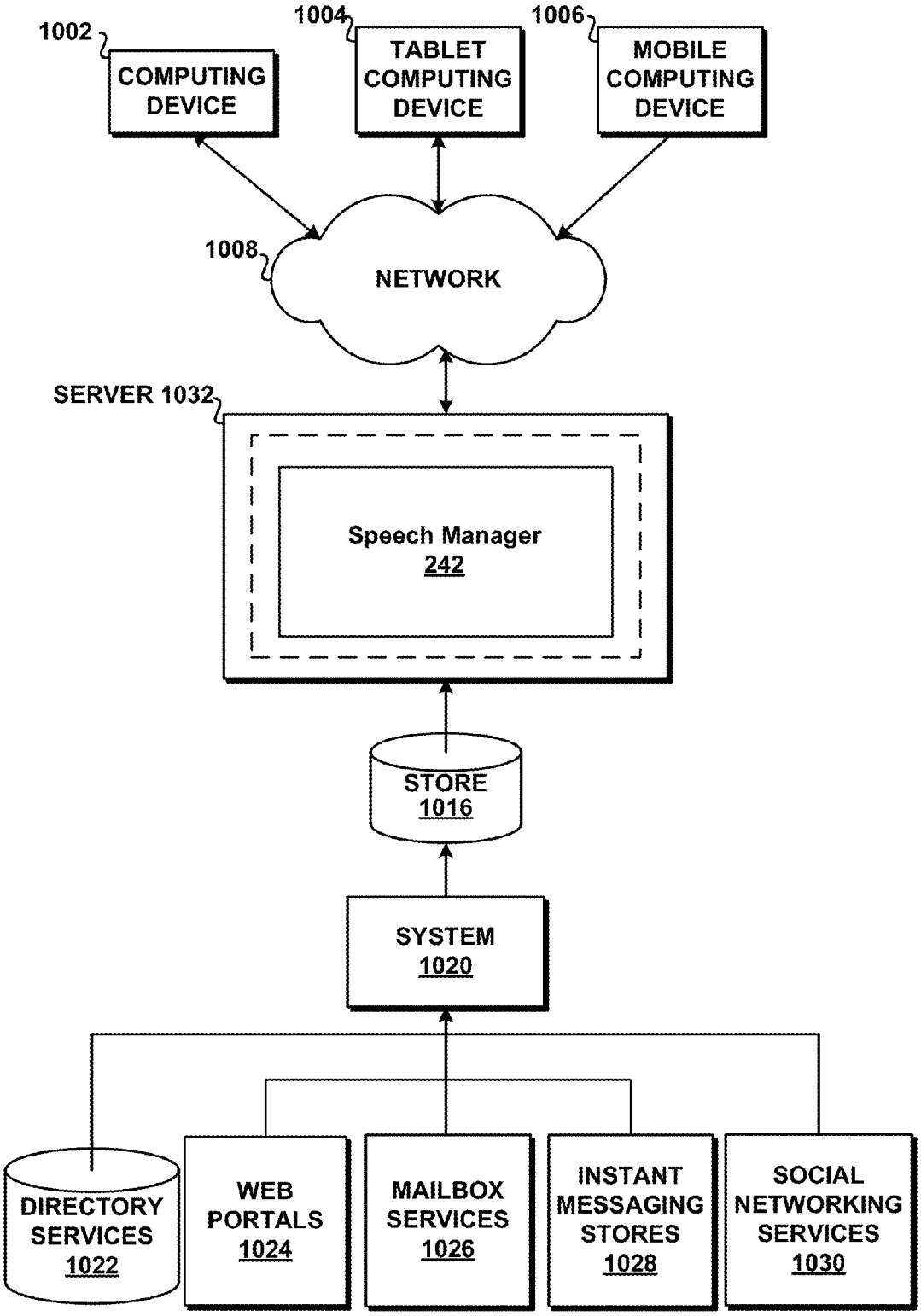

FIGS. 6-8 and the associated descriptions provide a discussion of a variety of operating environments in which embodiments of the invention may be practiced. However, the devices and systems illustrated and discussed with respect to FIGS. 6-8 are for purposes of example and illustration and are not limiting of a vast number of computing device configurations that may be utilized for practicing embodiments of the invention, described herein.

FIG. 6 is a block diagram illustrating example physical components of a computing device 900 with which embodiments of the invention may be practiced. The computing device components described below may be suitable for the computing devices described above. In a basic configuration, computing device 900 may include at least one processing unit 702 and a system memory 704. Depending on the configuration and type of computing device, system memory 704 may comprise, but is not limited to, volatile (e.g. random access memory (RAM)), non-volatile (e.g. read-only memory (ROM)), flash memory, or any combination. System memory 704 may include operating system 705, one or more programming modules 706, and may include a web browser application 720. Operating system 705, for example, may be suitable for controlling computing device 900's operation. In one embodiment, programming modules 706 may include a speech manager 242, as described above, installed on computing device 900. Furthermore, embodiments of the invention may be practiced in conjunction with a graphics library, other operating systems, or any other application program and is not limited to any particular application or system. This basic configuration is illustrated in FIG. 6 by those components within a dashed line 708.

Computing device 900 may have additional features or functionality. For example, computing device 900 may also include additional data storage devices (removable and/or non-removable) such as, for example, magnetic disks, optical disks, or tape. Such additional storage is illustrated in FIG. 6 by a removable storage 709 and a non-removable storage 710.

As stated above, a number of program modules and data files may be stored in system memory 704, including operating system 705. While executing on processing unit 702, programming modules 706, such as the manager may perform processes including, for example, method 400 as described above. The aforementioned process is an example, and processing unit 702 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip containing electronic elements or microprocessors. For example, embodiments of the invention may be practiced via a system-on-a-chip (SOC) where each or many of the components illustrated in FIG. 6 may be integrated onto a single integrated circuit. Such an SOC device may include one or more processing units, graphics units, communications units, system virtualization units and various application functionality all of which are integrated (or "burned") onto the chip substrate as a single integrated circuit. When operating via an SOC, the functionality, described herein, with respect to the manager 242 may be operated via application-specific logic integrated with other components of the computing device/system 900 on the single integrated circuit (chip). Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the invention, for example, may be implemented as a computer process (method), a computing system, or as an article of manufacture, such as a computer program product or computer readable media. The computer program product may be a computer storage media readable by a computer system and encoding a computer program of instructions for executing a computer process.

The term computer readable media as used herein may include computer storage media. Computer storage media may include volatile and nonvolatile, removable and non-removable media implemented in any method or technology for storage of information, such as computer readable instructions, data structures, program modules, or other data. System memory 704, removable storage 709, and non-removable storage 710 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 900. Any such computer storage media may be part of device 900. Computing device 900 may also have input device(s) 712 such as a keyboard, a mouse, a pen, a sound input device, a touch input device, etc. Output device(s) 714 such as a display, speakers, a printer, etc. may also be included. The aforementioned devices are examples and others may be used.

A camera and/or some other sensing device may be operative to record one or more users and capture motions and/or gestures made by users of a computing device. Sensing device may be further operative to capture spoken words, such as by a microphone and/or capture other inputs from a user such as by a keyboard and/or mouse (not pictured). The sensing device may comprise any motion detection device capable of detecting the movement of a user. For example, a camera may comprise a MICROSOFT KINECT® motion capture device comprising a plurality of cameras and a plurality of microphones.

The term computer readable media as used herein may also include communication media. Communication media may be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media.

FIGS. 7A and 7B illustrate a suitable mobile computing environment, for example, a mobile telephone, a smartphone, a tablet personal computer, a laptop computer, and the like, with which embodiments of the invention may be practiced. With reference to FIG. 7A, an example mobile computing device 800 for implementing the embodiments is illustrated. In a basic configuration, mobile computing device 800 is a handheld computer having both input elements and output elements. Input elements may include touch screen display 805 and input buttons 815 that allow the user to enter information into mobile computing device 800. Mobile computing device 800 may also incorporate an optional side input element 815 allowing further user input. Optional side input element 815 may be a rotary switch, a button, or any other type of manual input element. In alternative embodiments, mobile computing device 800 may incorporate more or less input elements. For example, display 805 may not be a touch screen in some embodiments. In yet another alternative embodiment, the mobile computing device is a portable phone system, such as a cellular phone having display 805 and input buttons 815. Mobile computing device 800 may also include an optional keypad 835. Optional keypad 815 may be a physical keypad or a "soft" keypad generated on the touch screen display.

Mobile computing device 800 incorporates output elements, such as display 805, which can display a graphical user interface (GUI). Other output elements include speaker 825 and LED light 820. Additionally, mobile computing device 800 may incorporate a vibration module (not shown), which causes mobile computing device 800 to vibrate to notify the user of an event. In yet another embodiment, mobile computing device 800 may incorporate a headphone jack (not shown) for providing another means of providing output signals.

Although described herein in combination with mobile computing device 800, in alternative embodiments the invention is used in combination with any number of computer systems, such as in desktop environments, laptop or notebook computer systems, multiprocessor systems, micro-processor based or programmable consumer electronics, network PCs, mini computers, main frame computers and the like. Embodiments of the invention may also be practiced in distributed computing environments where tasks are performed by remote processing devices that are linked through a communications network in a distributed computing environment; programs may be located in both local and remote memory storage devices. To summarize, any computer system having a plurality of environment sensors, a plurality of output elements to provide notifications to a user and a plurality of notification event types may incorporate embodiments of the present invention.

FIG. 7B is a block diagram illustrating components of a mobile computing device used in one embodiment, such as the computing device shown in FIG. 7A. That is, mobile computing device 800 can incorporate system 802 to implement some embodiments. For example, system 802 can be used in implementing a "smart phone" that can run one or more applications similar to those of a desktop or notebook computer such as, for example, browser, e-mail, scheduling, instant messaging, and media player applications. In some embodiments, system 802 is integrated as a computing device, such as an integrated personal digital assistant (PDA) and wireless phoneme.

One or more application programs 866 may be loaded into memory 862 and run on or in association with operating system 864. Examples of application programs include phoneme dialer programs, e-mail programs, PIM (personal information management) programs, word processing programs, spreadsheet programs, Internet browser programs, messaging programs, and so forth. System 802 also includes non-volatile storage 868 within memory 862. Non-volatile storage 868 may be used to store persistent information that should not be lost if system 802 is powered down. Applications 866 may use and store information in non-volatile storage 868, such as e-mail or other messages used by an e-mail application, and the like. A synchronization application (not shown) may also reside on system 802 and is programmed to interact with a corresponding synchronization application resident on a host computer to keep the information stored in non-volatile storage 868 synchronized with corresponding information stored at the host computer. As should be appreciated, other applications may be loaded into memory 862 and run on the device 800, including the speech manager 242, described above.

System 802 has a power supply 870, which may be implemented as one or more batteries. Power supply 870 might further include an external power source, such as an AC adapter or a powered docking cradle that supplements or recharges the batteries.

System 802 may also include a radio 872 that performs the function of transmitting and receiving radio frequency communications. Radio 872 facilitates wireless connectivity between system 802 and the "outside world", via a communications carrier or service provider. Transmissions to and from radio 872 are conducted under control of OS 864. In other words, communications received by radio 872 may be disseminated to application programs 866 via OS 864, and vice versa.

Radio 872 allows system 802 to communicate with other computing devices, such as over a network. Radio 872 is one example of communication media. Communication media may typically be embodied by computer readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

This embodiment of system 802 is shown with two types of notification output devices; LED 820 that can be used to provide visual notifications and an audio interface 874 that can be used with speaker 825 to provide audio notifications. These devices may be directly coupled to power supply 870 so that when activated, they remain on for a duration dictated by the notification mechanism even though processor 860 and other components might shut down for conserving battery power. LED 820 may be programmed to remain on indefinitely until the user takes action to indicate the powered-on status of the device. Audio interface 874 is used to provide audible signals to and receive audible signals from the user. For example, in addition to being coupled to speaker 825, audio interface 874 may also be coupled to a microphone 820 to receive audible input, such as to facilitate a telephone conversation. In accordance with embodiments of the present invention, the microphone 820 may also serve as an audio sensor to facilitate control of notifications, as will be described below. System 802 may further include video interface 876 that enables an operation of on-board camera 830 to record still images, video stream, and the like.

A mobile computing device implementing system 802 may have additional features or functionality. For example, the device may also include additional data storage devices (removable and/or non-removable) such as, magnetic disks, optical disks, or tape. Such additional storage is illustrated in FIG. 6B by storage 868. Computer storage media may include volatile and nonvolatile, removable and non-removable media implemented in any method or technology for storage of information, such as computer readable instructions, data structures, program modules, or other data.

Data/information generated or captured by the device 800 and stored via the system 802 may be stored locally on the device 800, as described above, or the data may be stored on any number of storage media that may be accessed by the device via the radio 872 or via a wired connection between the device 800 and a separate computing device associated with the device 800, for example, a server computer in a distributed computing network such as the Internet. As should be appreciated such data/information may be accessed via the device 800 via the radio 872 or via a distributed computing network. Similarly, such data/information may be readily transferred between computing devices for storage and use according to well-known data/information transfer and storage means, including electronic mail and collaborative data/information sharing systems.

FIG. 7 illustrates a system architecture for blending recorded speech with TTS output, as described above.

Components managed via the speech manager 242 may be stored in different communication channels or other storage types. For example, components along with information from which they are developed may be stored using directory services 1022, web portals 1024, mailbox services 1026, instant messaging stores 1028 and social networking sites 1030. The systems/applications 242, 1020 may use any of these types of systems or the like for enabling management and storage of components in a store 1016. A server 1032 may provide communications for managed components and content to clients. As one example, server 1032 may provide speech related services. Server 1032 may provide services and content over the web to clients through a network 1008.

Examples of clients that may utilize server 1032 include computing device 1002, which may include any general purpose personal computer, a tablet computing device 1004 and/or mobile computing device 1006 which may include smart phones. Any of these devices may obtain display component management communications and content from the store 1016.

Embodiments of the present invention are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method for blending recorded speech with text-to-speech (TTS) for specific domains, comprising:

receiving input text;

identifying a domain from the input text;

determining a static part from the input text that has previously been recorded and stored within a data store, wherein determining the static part comprises detecting the static part based on recorded units for the identified domain;

determining a dynamic part from the input text; and blending the static part with the dynamic part within a TTS engine.

2. The method of claim 1, wherein blending the static part with the dynamic part within the TTS engine comprises smoothing an acoustic trajectory of a transition between the static part and the dynamic part based on the recorded units for the static part and a predicted trajectory.

3. The method of claim 1, further comprising creating a transition at a boundary of the static part and the dynamic part.

4. The method of claim 1, further comprising obtaining a speech output from a text to speech (TTS) synthesizer.

5. The method of claim 1, further comprising attempting to maintain a prosody of the static part in the dynamic part output by a TTS synthesizer.

6. The method of claim 1, further comprising splitting a portion of identified non-uniform units from the input text into a transition part and a central part.

7. The method of claim 6, wherein the central part of the identified non-uniform units excludes a part of the identified non-uniform units used for transition between uniform parts and the identified non-uniform units.

8. A computer storage device having computer-executable instructions for blending recorded speech with text-to-speech (TTS) for specific domains, comprising:

receiving input text;

identifying a domain from the input text that identifies a type of speech application;

determining a static part from the input text that has previously been recorded and stored within a data store, wherein determining the static part comprises detecting the static part based on recorded units for the identified domain;

determining a dynamic part from the input text; and blending the static part with the dynamic part within a TTS engine.

9. The computer storage device of claim 8, wherein blending the static part with the dynamic part within the TTS engine comprises smoothing an acoustic trajectory of a transition between the static part and the dynamic part based on recorded units for the static part and a predicted trajectory.

10. The computer storage device of claim 8, further comprising creating a transition at a boundary of the static part and the dynamic part.

11. The computer storage device of claim 8, further comprising attempting to maintain a prosody of the static part in the dynamic part output by a TTS synthesizer.

12. The computer storage device of claim 8, further comprising splitting a portion of identified non-uniform units from the input text into a transition part and a central part and adjusting the transition part to smooth a transition between uniform units.

13. A system for blending recorded speech with text-to-speech (TTS) for specific domains, comprising:

a processor and a computer-readable medium;

an operating environment stored on the computer-readable medium and executing on the processor; and a manager operating under the control of the operating environment and operative to actions comprising:

receiving input text;

identifying a domain from the input text that identifies a type of speech application;

determining a static part from the input text that has previously been recorded and stored within a data store, wherein determining the static part comprises detecting the static part based on recorded units for the identified domain;

locating recorded speech for the static part from the data store;

determining a dynamic part from the input text; and blending the recorded speech with the static part with the dynamic part within a TTS engine.

14. The system of claim 13, wherein blending the static part with the dynamic part within the TTS engine comprises smoothing an acoustic trajectory of a transition between the static part and the dynamic part based on recorded units for the static part and a predicted trajectory.

15. The system of claim 13, further comprising creating a transition at a boundary of the static part and the dynamic part.

16. The system of claim 13, further comprising attempting to maintain a prosody of the static part in the dynamic part output by a TTS synthesizer and splitting a portion of identified non-uniform units from the input text into a transition part and a central part and adjusting the transition part to smooth a transition between uniform units.

17. The method of claim 8, further comprising adjusting the transition part to smooth a transition between uniform units.

18. The method of claim 8, wherein the transition part is located near a boundary between the non-uniform units and uniform units.

19. The computer storage device of claim 12, wherein the transition part is located near a boundary between the non-uniform units and the uniform units.

20. The system of claim 16, wherein the transition part is located near a boundary between the non-uniform units and the uniform units.

* * * * *